US009382506B2

(12) United States Patent
Catlin et al.

(10) Patent No.: US 9,382,506 B2
(45) Date of Patent: Jul. 5, 2016

(54) DETERGENT PRODUCTS, METHODS AND MANUFACTURE

(71) Applicant: The Procter & Gamble Company, Cincinnati, OH (US)

(72) Inventors: Tanguy Marie Louis Alexandre Catlin, Brussels (BE); Rachid Ben Moussa, Overuse (BE); Timothy Bernard William Kroese, Strombeek-Bever (BE); Charles Rupert Gillham, Jesmond (GB); James Ian Kinloch, Northumberland (GB); David John Smith, England (GB); Alison Lesley Main, Cincinnati, OH (US); Helen Varley, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 111 days.

(21) Appl. No.: 14/191,970

(22) Filed: Feb. 27, 2014

(65) Prior Publication Data

US 2014/0179584 A1 Jun. 26, 2014

Related U.S. Application Data

(60) Continuation of application No. 13/411,895, filed on Mar. 5, 2012, now Pat. No. 8,940,676, which is a continuation of application No. 13/409,139, filed on Mar. 1, 2012, now Pat. No. 8,435,935, which is a continuation of application No. 13/182,659, filed on Jul. 14, 2011, now Pat. No. 8,658,585, which is a continuation of application No. 13/182,610, filed on Jul. 14, 2011, now Pat. No. 8,518,866, which is a continuation of application No. 11/975,449, filed on Oct. 19, 2007, now Pat. No. 8,156,713, which is a division of application No. 10/978,941, filed on Nov. 1, 2004, now Pat. No. 7,386,971, which is a division of application No. 09/994,533, filed on Nov. 27, 2001, now Pat. No. 7,125,828.

(60) Provisional application No. 60/265,462, filed on Jan. 31, 2001.

(30) Foreign Application Priority Data

| | | |
|---|---|---|
| Nov. 27, 2000 | (GB) | 0028821.7 |
| Nov. 27, 2000 | (GB) | 0028823.3 |
| May 5, 2001 | (GB) | 0111131.9 |
| Nov. 14, 2001 | (GB) | 0127279.8 |

(51) Int. Cl.

| | |
|---|---|
| ***C11D 17/04*** | (2006.01) |
| ***B65B 9/04*** | (2006.01) |
| ***B65B 47/10*** | (2006.01) |
| ***B65D 85/808*** | (2006.01) |
| ***C11D 3/22*** | (2006.01) |
| ***C11D 3/386*** | (2006.01) |
| ***C11D 3/39*** | (2006.01) |
| ***C11D 11/00*** | (2006.01) |
| ***C11D 17/00*** | (2006.01) |
| ***C11D 1/722*** | (2006.01) |

(52) U.S. Cl.

CPC ..... *C11D 17/045* (2013.01); *B65B 9/04* (2013.01); *B65B 9/042* (2013.01); *B65B 47/10* (2013.01); *B65D 85/808* (2013.01); *C11D 1/722* (2013.01); *C11D 3/225* (2013.01); *C11D 3/386* (2013.01); *C11D 3/3942* (2013.01); *C11D 3/3947* (2013.01); *C11D 11/0023* (2013.01); *C11D 17/003* (2013.01); *C11D 17/0004* (2013.01); *C11D 17/042* (2013.01); *C11D 17/043* (2013.01); *C11D 17/044* (2013.01)

(58) Field of Classification Search

CPC ..... C11D 3/386; C11D 17/042

See application file for complete search history.

(56) References Cited

U.S. PATENT DOCUMENTS

| | | | |
|---|---|---|---|
| 2,420,983 | A | 5/1947 | Salfiseberg |
| 2,541,387 | A | 2/1951 | Salfisberg |
| 3,218,776 | A | 11/1965 | Cloud |
| 3,502,487 | A | 3/1970 | Byrd |
| 3,528,921 | A | 9/1970 | Gray |
| 3,638,784 | A | 2/1972 | Bodolay et al. |
| 3,705,102 | A | 12/1972 | Mast |
| 3,766,702 | A | 10/1973 | Meissner et al. |
| D234,751 | S | 4/1975 | Brodsky |
| 4,082,678 | A | 4/1978 | Pracht et al. |
| 4,115,292 | A | 9/1978 | Richardson et al. |
| 4,154,636 | A | 5/1979 | Motoyama et al. |
| 4,162,987 | A | 7/1979 | Maguire, Jr. et al. |
| 4,176,079 | A | 11/1979 | Guerry et al. |
| 4,201,031 | A | 5/1980 | Wiles |
| 4,262,473 | A | 4/1981 | Brooke |
| 4,375,146 | A | 3/1983 | Chung |
| 4,410,441 | A | 10/1983 | Davies et al. |
| 4,416,791 | A | 11/1983 | Haq |
| 4,571,924 | A | 2/1986 | Bahrani |
| 4,622,161 | A | 11/1986 | Cornelissens et al. |
| 4,638,907 | A | 1/1987 | Bedenk et al. |
| 4,684,025 | A | 8/1987 | Copland et al. |
| 4,732,299 | A | 3/1988 | Hoyt |
| 4,747,976 | A | 5/1988 | Yang et al. |
| 4,776,455 | A | 10/1988 | Anderson et al. |

(Continued)

FOREIGN PATENT DOCUMENTS

| | | |
|---|---|---|
| EP | 0 132 726 A2 | 2/1985 |
| EP | 0 261 754 B1 | 9/1991 |

(Continued)

*Primary Examiner* — Gregory Webb

(74) *Attorney, Agent, or Firm* — Gregory S. Darley-Emerson; Leonard W. Lewis; Steven W Miller

(57) ABSTRACT

A water-soluble pouch suitable for use in machine dishwashing and which comprises a plurality of compartments in generally superposed or superposable relationship, each containing one or more detergent active or auxiliary components, and wherein the pouch has a volume of from about 5 to about 70 ml and a longitudinal/transverse aspect ratio in the range from about 2:1 to about 1:8, preferably from about 1:1 to about 1:4. The water-soluble pouch allows for optimum delivery of dishwashing detergent. A process for the manufacture of multi-compartment pouches and a pack to contain the pouches are also disclosed.

20 Claims, No Drawings

(56) References Cited

U.S. PATENT DOCUMENTS

| | | | | |
|---|---|---|---|---|
| 4,818,427 | A | 4/1989 | Altenschoepfer et al. | |
| 4,828,744 | A | 5/1989 | Kaufmann et al. | |
| 4,840,271 | A | 6/1989 | Garwood | |
| 4,885,105 | A | 12/1989 | Yang et al. | |
| 4,929,380 | A | 5/1990 | Schulz et al. | |
| 4,973,416 | A | 11/1990 | Kennedy | |
| 5,015,513 | A | 5/1991 | Newbold et al. | |
| 5,016,425 | A | 5/1991 | Weick | |
| 5,081,819 | A | 1/1992 | Cloud | |
| 5,110,641 | A | 5/1992 | Kean | |
| 5,132,036 | A | 7/1992 | Falou et al. | |
| 5,141,664 | A | 8/1992 | Corring et al. | |
| 5,146,730 | A | 9/1992 | Sadek et al. | |
| 5,160,654 | A | 11/1992 | Falou | |
| 5,224,601 | A | 7/1993 | Gouge et al. | |
| 5,248,038 | A | 9/1993 | Hodakowski et al. | |
| 5,272,191 | A | 12/1993 | Ibrahim et al. | |
| D343,573 | S | 1/1994 | Shadrach et al. | |
| 5,280,835 | A | 1/1994 | Edwards et al. | |
| 5,328,025 | A | 7/1994 | Hodakowski et al. | |
| 5,330,047 | A | 7/1994 | Gouge et al. | |
| 5,336,430 | A | 8/1994 | Bahary et al. | |
| 5,351,831 | A | 10/1994 | Gouge et al. | |
| 5,362,413 | A * | 11/1994 | Kaufmann | C11D 1/72 510/296 |
| 5,362,532 | A | 11/1994 | Famili et al. | |
| 5,384,364 | A | 1/1995 | Besse et al. | |
| 5,394,990 | A | 3/1995 | Edwards et al. | |
| 5,395,616 | A | 3/1995 | Edwards et al. | |
| 5,395,617 | A | 3/1995 | Edwards et al. | |
| 5,403,589 | A | 4/1995 | Edwards et al. | |
| 5,407,680 | A | 4/1995 | Edwards et al. | |
| 5,419,909 | A | 5/1995 | Edwards et al. | |
| 5,422,113 | A | 6/1995 | Edwards et al. | |
| RE34,988 | E | 7/1995 | Yang et al. | |
| 5,429,242 | A | 7/1995 | Edwards et al. | |
| 5,429,874 | A | 7/1995 | VanPutte | |
| 5,464,097 | A | 11/1995 | Edwards et al. | |
| 5,516,562 | A | 5/1996 | Edwards et al. | |
| 5,518,790 | A | 5/1996 | Huber et al. | |
| 5,540,989 | A | 7/1996 | Maul et al. | |
| 5,624,034 | A | 4/1997 | Edwards et al. | |
| 5,629,060 | A | 5/1997 | Garwood | |
| 5,678,177 | A | 10/1997 | Beasley | |
| 5,682,726 | A | 11/1997 | Green et al. | |
| 5,724,789 | A | 3/1998 | Corella | |
| 5,783,541 | A | 7/1998 | Tack et al. | |
| 5,805,768 | A | 9/1998 | Schwartz et al. | |
| 5,806,285 | A | 9/1998 | Rizzieri | |
| 5,827,586 | A | 10/1998 | Yamashita et al. | |
| 5,830,543 | A | 11/1998 | Miyake et al. | |
| 5,863,885 | A | 1/1999 | Ruggieri et al. | |
| 5,914,368 | A | 6/1999 | Haschke et al. | |
| 5,929,007 | A | 7/1999 | Feng | |
| 5,944,709 | A | 8/1999 | Barney et al. | |
| 6,037,319 | A | 3/2000 | Dickler et al. | |
| 6,089,374 | A | 7/2000 | Edwards et al. | |
| 6,090,771 | A | 7/2000 | Burt et al. | |
| 6,096,153 | A | 8/2000 | Nowaczyk | |
| 6,124,036 | A | 9/2000 | Brown et al. | |
| 6,133,214 | A | 10/2000 | Jung et al. | |
| 6,136,776 | A | 10/2000 | Dickler et al. | |
| 6,193,058 | B1 | 2/2001 | Yacko et al. | |
| 6,228,825 | B1 | 5/2001 | Gorlin et al. | |
| 6,244,746 | B1 | 6/2001 | Tokita et al. | |
| D445,673 | S | 7/2001 | Richardson | |
| D445,675 | S | 7/2001 | Richardson | |
| 6,281,183 | B1 | 8/2001 | Harbour | |
| 6,303,553 | B1 | 10/2001 | Gorlin | |
| D451,795 | S | 12/2001 | Ghatlia et al. | |
| D452,143 | S | 12/2001 | Ghatlia et al. | |
| 6,363,693 | B1 | 4/2002 | Edwards et al. | |
| 6,371,187 | B1 | 4/2002 | Nowaczyk | |
| 6,378,274 | B1 | 4/2002 | Harbour | |
| 6,387,862 | B2 | 5/2002 | Busch et al. | |
| 6,387,873 | B1 | 5/2002 | Carter et al. | |
| 6,440,051 | B1 | 8/2002 | Lauzon et al. | |
| 6,448,212 | B1 | 9/2002 | Holderbaum et al. | |
| 6,451,750 | B2 | 9/2002 | Hewitt et al. | |
| 6,465,408 | B1 | 10/2002 | Lee et al. | |
| 6,465,413 | B1 | 10/2002 | Hinton | |
| 6,475,975 | B1 | 11/2002 | Kinscherf et al. | |
| 6,475,977 | B1 | 11/2002 | Pfeiffer et al. | |
| 6,479,448 | B2 | 11/2002 | Cropper et al. | |
| 6,479,449 | B1 | 11/2002 | Mondin | |
| 6,482,785 | B1 | 11/2002 | Mondin | |
| 6,486,109 | B1 | 11/2002 | Mondin | |
| 6,486,116 | B1 | 11/2002 | Hinton | |
| 6,492,312 | B1 | 12/2002 | Pfeiffer et al. | |
| 6,495,503 | B1 | 12/2002 | Zappone et al. | |
| 6,495,504 | B1 | 12/2002 | Schramm, Jr. et al. | |
| 6,495,505 | B1 | 12/2002 | Reul et al. | |
| 6,670,314 | B2 | 12/2003 | Smith et al. | |
| 6,683,038 | B2 | 1/2004 | Forth et al. | |
| 6,740,628 | B2 | 5/2004 | Bennie et al. | |
| 6,846,795 | B2 | 1/2005 | Lant et al. | |
| 6,878,679 | B2 | 4/2005 | Roberts et al. | |
| 6,881,713 | B2 | 4/2005 | Roberts et al. | |
| 6,883,295 | B1 | 4/2005 | Negri et al. | |
| 6,989,072 | B2 | 1/2006 | Catlin et al. | |
| 6,998,375 | B2 | 2/2006 | Kapur et al. | |
| 7,125,828 | B2 | 10/2006 | Catlin et al. | |
| 7,271,141 | B2 | 9/2007 | Kaiser et al. | |
| 7,282,472 | B2 | 10/2007 | Kapur et al. | |
| 7,386,971 | B2 | 6/2008 | Catlin et al. | |
| 7,439,215 | B2 | 10/2008 | Catlin et al. | |
| 7,578,114 | B2 | 8/2009 | Duffield et al. | |
| 2001/0026792 | A1 | 10/2001 | Farrell et al. | |
| 2001/0031714 | A1 | 10/2001 | Gassenmeier et al. | |
| 2002/0004472 | A1 | 1/2002 | Holderbaum et al. | |
| 2002/0004473 | A1 | 1/2002 | Busch et al. | |
| 2002/0013232 | A1 | 1/2002 | Kinoshita et al. | |
| 2002/0013242 | A1 | 1/2002 | Baillely et al. | |
| 2002/0013243 | A1 | 1/2002 | Hewitt et al. | |
| 2002/0026771 | A1 | 3/2002 | Brown | |
| 2002/0028756 | A1 | 3/2002 | Carter et al. | |
| 2002/0033004 | A1 | 3/2002 | Edwards et al. | |
| 2002/0045559 | A1 | 4/2002 | Forth et al. | |
| 2002/0055449 | A1 | 5/2002 | Porta et al. | |
| 2002/0068010 | A1 | 6/2002 | Bartsch et al. | |
| 2002/0086806 | A1 | 7/2002 | Giblin et al. | |
| 2002/0094942 | A1 | 7/2002 | Danneels et al. | |
| 2002/0115583 | A1 | 8/2002 | Lant et al. | |
| 2002/0119903 | A1 | 8/2002 | Lant et al. | |
| 2002/0123443 | A1 | 9/2002 | Bennie et al. | |
| 2002/0123444 | A1 | 9/2002 | Fisher et al. | |
| 2002/0137648 | A1 | 9/2002 | Sharma et al. | |
| 2002/0142931 | A1 | 10/2002 | DeNome et al. | |
| 2002/0166779 | A1 | 11/2002 | Etesse et al. | |
| 2002/0169092 | A1 | 11/2002 | Catlin et al. | |
| 2002/0169095 | A1 | 11/2002 | Forth et al. | |
| 2002/0198125 | A1 | 12/2002 | Jones | |
| 2003/0050209 | A1 | 3/2003 | Perkis et al. | |
| 2003/0050210 | A1 | 3/2003 | Pounds et al. | |
| 2003/0170357 | A1 | 9/2003 | Garwood | |
| 2004/0031717 | A1 | 2/2004 | Edwards et al. | |
| 2004/0063598 | A1 | 4/2004 | Riebe et al. | |
| 2004/0172917 | A1 | 9/2004 | Duffield | |
| 2005/0022476 | A1 | 2/2005 | Hamer et al. | |
| 2005/0061703 | A1 | 3/2005 | Catlin et al. | |
| 2005/0065051 | A1 | 3/2005 | Catlin et al. | |
| 2007/0004612 | A1 | 1/2007 | Catlin et al. | |
| 2008/0041020 | A1 | 2/2008 | Catlin et al. | |

FOREIGN PATENT DOCUMENTS

| | | | | |
|---|---|---|---|---|
| EP | 0 593 952 | A1 | 4/1994 | |
| EP | 0 846 757 | A2 | 6/1998 | |
| EP | 0 879 874 | A2 | 11/1998 | |
| NL | WO 9206173 | A1 * | 4/1992 | C11D 17/042 |
| WO | WO 96/24328 | A1 | 8/1996 | |

* cited by examiner

DETERGENT PRODUCTS, METHODS AND MANUFACTURE

TECHNICAL FIELD

The present invention is in the field of dishwashing, in particular it relates to a water soluble multi-compartment pouch adapted to fit the dishwasher dispenser and to deliver product into the pre-wash, main wash and/or post-rinse cycles of the dishwashing machine. The pouch contains a cleaning composition for release on dissolution of the pouch. The invention also relates to a process for the manufacture of the pouches and to a pack for the storage, distribution and display of the pouches.

BACKGROUND OF THE INVENTION

Unitised doses of dishwashing detergents are found to be more attractive and convenient to some consumers because they avoid the need of the consumer to measure the product thereby giving rise to a more precise dosing and avoiding wasteful overdosing or underdosing. For this reason automatic dishwashing detergent products in tablet form have become very popular. Detergent products in pouch form are also known in the art, they have the advantage over tablets of avoiding the contact of the consumer fingers with the dishwashing composition which may contain bleach and/or other irritant substances.

The automatic dishwashing process usually involves an initial pre-wash cycle, main-wash cycle and several hot rinse cycles. Better performance is obtained when the detergent is delivered at the beginning of the main-wash cycle than when the detergent is delivered in the pre-wash cycle since it can be lost with the initial water. In laundry washing machines the detergent can be placed in the drum or in the dispenser, however, in dishwashers the detergent is generally delivered into the main wash via the dispenser to avoid premature dissolution in the pre-wash. The amount of detergent is therefore limited by the volume of the dispenser. Dispensers vary in volume and shape from manufacturer to manufacturer. In the case of detergent in loose form (i.e., powders, paste and liquids), the volume of the dispenser is a decisive factor. In the case of unit dose forms, such as tablet, the geometry and shape of the dispenser plays also a very important role.

Tablets can be designed to have a size and shape which fit all machines. One of the drawbacks of detergent tablets is the fact that their manufacturing process requires the additional step of powder compaction. This decreases enzyme activity and slows down the dissolution rate of the ingredients forming the tablet, or requires the use of complex and expensive disintegrated systems, or makes it difficult to achieve differential dissolution of the detergent active ingredients.

Some detergent ingredients used in dishwashing detergent compositions are liquids. These liquid ingredients can be difficult or costly to include in a solid detergent composition. Also, certain ingredients are preferably transported and supplied to detergent manufacturers in a liquid form and require additional, and sometimes costly, process steps to enable them to be included in a solid detergent composition. An example of these detergent ingredients is surfactant, especially nonionic surfactant which are typically liquid at room temperature or are typically transported and supplied to detergent manufacturers in liquid form. Another example is organic solvents.

Current methods of incorporating liquid ingredients into solid detergent compositions include absorbing the liquid ingredient onto a solid carrier, for example by mixing, agglomeration or spray-on techniques. Typically, solid detergent compositions comprise only low amounts of these liquid detergent ingredients due to the difficulty and expense of incorporating these liquid ingredients into a solid detergent. Furthermore, the incorporation of liquid ingredients into solid detergent compositions can impact on the dissolution characteristics of the composition (for example as the result of forming surfactant gel phases), can increase the moisture pick-up by water sensitive ingredients and can also lead to problems of flowability. It would be advantageous to have a detergent composition which allows the different ingredients to be in their natural state i.e., liquid or solid. This would facilitate the manufacturing process, increase the component stability and furthermore allow the delivery of liquid ingredients prior or post to the delivery of solid ingredients. For example differential dissolution of active ingredients would be beneficial in the case of enzyme/bleach compositions to avoid oxidation of enzymes by the bleach in the dishwashing liquor. It would also be advantageous to separate bleach from perfume.

Another factor that can contribute to the inefficient delivery of actives to the wash, in the case of tablets, is the need for adding carrier materials, as for example porous materials able to bind active liquid materials, binders and disintegrates. In particular, the incorporation of liquid surfactants to powder form detergent compositions can raise considerable processing difficulties and also the problem of poor dissolution through the formation of surfactant gel phases.

There is still the need for a multi-compartment unitised dose form capable of fitting the dispensers of different dishwashing machine types and which allows for the simultaneous delivery of incompatible ingredients and ingredients in different physical forms. There is also need for a simplified manufacturing process for multi-compartment pouch production and for multi-compartment pouches with improved strength, handling and dissolution characteristics as well as excellent aesthetics.

The most common process for making water-soluble pouches with products such as cleaning products is the so-called vertical form-fill-sealing process. Hereby, a vertical tube is formed by folding a film. The bottom end of the tube is sealed to give rise to an open pouch. This pouch is partially filled allowing a head space whereby the top part of the open pouch is then subsequently sealed together to close the pouch, and to give rise to the next open pouch. The first pouch is subsequently cut and the process is repeated. The pouches formed in such a way usually have pillow shape.

A second known process for making pouches is by use of a die having a series of moulds and forming from a film, open pouches in these moulds, which can then be filled and sealed. This method uses the pouch film material more efficiently and the process has more flexibility in terms of pouch shapes and ingredients used. However, the process has limited suitability for industrial application, because it cannot produce large quantities of pouches (per time unit), in an easy and efficient manner.

A third process proposed is the formation of pouches in moulds present on the surface of a circular drum. Hereby, a film is circulated over the drum and pockets are formed, which pass under a filling machine to fill the open pockets. The filling and sealing needs to take place at the highest point (top) of the circle described by the drum, e.g. typically, filling is done just before the rotating drum starts the downwards circular motion, and sealing just after the drum starts its downwards motion.

One problem associated with the vertical filling machine is that the process is not very efficient: the process is intermittent and very slow, for example due to process speed changes from one step to the next step, and each pouch formation step result typically only in one string of pouches in one dimension; thus, only a limited amount of pouches per minute can be formed. Moreover, large quantities of film are used per product dose, because the method does not allow complete filling of the pouches, there is a substantial seal along the vertical dimension of each pouch, and the method does not allow stretching of the film. Also, there is not much flexibility in shapes of pouches formed.

Problems associated with the second process using a die with moulds include also the fact that the process is intermittent (or an indexing process), and that the process is slow and involves acceleration and deceleration, which reduces the overall speed and moreover, causes product spillage out of the open pouches. Also, the output of this process is not very high (per time unit).

The circular drum process overcomes some of the disadvantages of these processes because it does not entail speed changes (no acceleration/deceleration), it can readily provide pouches arranged in two dimensions and the shape of the pouches can be varied to some extent. However, spillage from the pouches can be quite substantial, due to the circular movement, which causes product to spill onto the sealing area, and this can cause problems with sealing (leaking seals). Also, the process does not allow the pouches to be filled completely, because the spillage is then even more of a problem. Also, this process has even more significant problems when used for liquid products, which are more likely to cause large spillage, due to the circular motion. Moreover, the filling and sealing has to be done around the highest point of the circular path of the drum, thereby hugely reducing the overall speed and the output of the pouch formation process.

All the known processes, moreover are designed primarily for making single compartment pouches. There is still need for a process to make multi-compartment water-soluble pouches which overcome the above issues, namely a continuous process, with a fast production rate and which minimize the amount of film used for each pouch. There is also a need for a process of making multi-compartment water-soluble pouches having improved strength and adapted for use in machine dishwashing.

SUMMARY OF THE INVENTION

According to a first aspect of the present invention, there is provided a machine dishwashing product in the form of water-soluble pouch. The pouch comprises a plurality of compartments in generally superposed or superposable relationship, for example, the plurality of compartments can be symmetrically arranged one above another, side by side (such that they can be folded into a superposed relationship) or any other convenient disposition provided that the compartments are superposable in use. Each compartment contains one or more detergent active components or detergent auxiliaries. Water-soluble pouches comprising a plurality of compartments are herein referred to as multi-compartment pouches. Multi-compartment pouches in which the compartments are in a superposed relationship are especially advantageous when one or more of the compartments comprise a moisture sensitive ingredient, because the compartment comprising a moisture sensitive ingredient can be placed in intermediate or bottom layers and thus they have less surface area exposed to the surrounding environment, therefore reducing the possibility of picking up moisture from the surroundings.

The pouch preferably has a volume of from about 5 to about 70 ml, preferably from about 15 to about 60 ml, more preferably from about 18 to 57 ml, and a longitudinal/transverse aspect ratio in the range from about 2:1 to about 1:8, preferably from about 1:1 to about 1:4. The longitudinal dimension is defined as the maximum height of the pouch when the pouch is lying on one of the bases which has the maximum footprint with the pouch compartments superposed in a longitudinal direction, i.e. one over another, and under a static load of about 2 Kg. The transverse dimension is defined as the maximum width of the pouch in a plane perpendicular to the longitudinal direction under the same conditions. These dimensions are adequate to fit the dispensers of the majority of dishwashers. Although the shape of the pouch can vary widely, in order to maximize the available volume, preferred pouches have a base as similar as possible to the footprint of the majority of the dispensers, that is generally rectangular.

In one embodiment the plurality of compartments of the water-soluble pouch are in generally superposed relationship and the pouch comprises upper and lower generally opposing outer walls, a skirt-like side walls, forming the sides of the pouch, and one or more internal partitioning walls, separating different compartments from one another, and wherein each of said upper and lower outer walls and skirt-like side wall are formed by thermoforming, vacuum forming or a combination thereof.

Thus, according to another aspect of the invention there is provided a machine dishwashing product in the form of a water-soluble pouch comprising a plurality of compartments in generally superposed relationship, each compartment containing one more detergent active or auxiliary components, wherein the pouch comprises upper and lower generally opposing outer walls, a skirt-like side wall and one or more internal partitioning walls, and wherein each of said upper and lower outer walls and said skirt-like side wall are formed by thermoforming, vacuum forming or a combination thereof.

In a preferred embodiment each internal partitioning wall of the water-soluble multi-compartment pouch is secured to an outer or side wall of the pouch along a single seal line or to both an outer and a side wall of the pouch along a plurality of seal lines that are at least partially non-overlapping. Preferably each partitioning wall is secured to one or more outer or sides wall by heat or solvent sealing.

In especially preferred embodiments at least one internal partitioning wall of the multi-compartment pouch is secured to an upper or lower outer wall along a first continuous seal line and one or both of said outer wall and said partitioning wall are secured to the skirt-like side wall along a second continuous seal line and wherein the seal lines in the case of heat seals are essentially non-overlapping and in the case of solvent seals are at least partially non-overlapping.

Non-overlapping seal lines are particularly advantageous in the case of multi-compartment pouches made by a process involving several non-simultaneous heat sealing steps. Without wishing to be bound by theory, it is believed that the heat seal mechanism involves the step of water evaporation from the film, therefore it is very difficult to achieve a good overlapping seal unless the two seals are formed simultaneously. Heat sealing is preferred in cases in which the pouches are filled with water sensitive components. Solvent sealing can reduce processing cost, can produce stronger seals and can make the process faster. Partially non-overlapping seals allow for the superposition of a plurality of compartments of different sizes.

Preferably, at least one internal partitioning wall of the multi-compartment pouch is secured to the upper outer wall along a first seal line defining the waist line of the skirt-like wall and wherein the second non-overlapping or at least partially non-overlapping seal is preferably off-set below the waist line-defining seal line in the direction of the lower outer wall. The skirt-like side wall is also preferably slightly gathered or puckered in the final pouch to provide a mattress-like appearance.

Thus, according to another aspect of the invention, there is provided a machine dishwashing product in the form of a water-soluble pouch comprising a plurality of compartments in generally superposed relationship, each compartment containing one more detergent active components, wherein the pouch comprises upper and lower generally opposing outer walls, a skirt-like side wall and one or more internal partitioning walls wherein at least one internal partitioning wall is secured to an upper or lower outer wall along a first seal line and one or both of said outer wall and said partitioning wall are secured to the skirt-like side wall along a second seal line and wherein the seal lines are at least partially non-overlapping.

In another embodiment the water-soluble pouch comprises a plurality of compartments in side-by-side but generally superposable relationship (for example, the compartments can be folded over each other). The pouch comprises upper and lower generally opposing outer walls, one or more skirt-like side walls and one or more external partitioning walls, and wherein each of said upper and lower outer walls and skirt-like side walls are formed by thermoforming, vacuum forming or a combination thereof.

In one embodiment at least one of the plurality of compartments of the water-soluble pouch comprises a powder or densified powder composition. The powder composition usually comprises traditional solid materials used in dishwashing detergent, such as builders, alkalinity sources, enzymes, bleaches, etc. The powder composition can be in the form of dry powder, hydrated powder, agglomerates, encapsulated materials, extrudates, tablets or mixtures thereof. It is also useful to have water-soluble pouches with several compartments comprising different powder compositions, usually compositions in different compartments comprise incompatible actives or actives which need to be delivered at different times of the dishwashing process. It is advantageous to have bleach and enzymes in different compartments.

In a preferred embodiment at least one of the powder compartments comprises particulate bleach. The bleach is preferably selected from inorganic peroxides inclusive of perborates and percarbonates, organic peracids inclusive of preformed monoperoxy carboxylic acids, such as phthaloyl amido peroxy hexanoic acid and di-acyl peroxides.

In the case of powder compositions differential dissolution can be obtained, for example, by varying the degree of powder compression and/or particle size of the powder compositions in the same or different compartments. Another way to obtain differential dissolution is to use water-soluble films of different thickness or different degree or rate of solubility under in-use conditions. Film solubility can be controlled by for example pH, temperature, ionic strength or any other means. For purposes of achieving phased or sequential delivery of detergent actives, it is preferred that each of the compartments of the pouch have a different disintegration rate or dissolution profile under in-use conditions.

In another embodiment at least one of the plurality of compartments of the water-soluble pouch comprises a liquid composition. The liquid compositions comprise traditional liquid materials used in dishwashing detergents, such as non-ionic surfactants or the organic solvents described hereinbelow. In preferred embodiments the liquid composition comprises detergency enzyme. Especially useful are water-soluble pouches having one compartment comprising a liquid composition and another compartment comprising a solid composition. In the case of liquid compositions, especially liquid compositions enclosed within a secondary pack, it is desirable to have a water content in the composition similar to the water content in the film in order to avoid transfer of water from one to another. In cases in which the content of water is lower in the composition than in the film, water can migrate from the film to the composition making the water-soluble pouch brittle. For similar reasons, it is also desirable to have a similar amount of plasticiser in the composition and in the film.

In another embodiment at least one of the plurality of compartments of the water-soluble pouch comprises a composition in the form of a paste. The multi-compartment pouches can also include compositions in the form of a gel or a wax.

In preferred embodiments at least one of the plurality of compositions of the water-soluble pouch comprises an organic solvent system compatible with the water-soluble pouch. The organic solvent system can simply act as a liquid carrier, but in preferred compositions, the solvent can aid removal of cooked-, baked- or burnt-on soil and thus has detergent functionality in its own right. The organic solvent system (comprising a single solvent compound or a mixture of solvent compounds) preferably has a volatile organic content above 1 mm Hg and more preferably above 0.1 mm Hg of less than about 50%, preferably less than about 20% and more preferably less than about 10% by weight of the solvent system. Herein volatile organic content of the solvent system is defined as the content of organic components in the solvent system having a vapor pressure higher than the prescribed limit at 25° C. and atmospheric pressure.

The organic solvent system for use herein is preferably selected from organoamine solvents, inclusive of alkanolamines, alkylamines, alkyleneamines and mixtures thereof; alcoholic solvents inclusive of aromatic, aliphatic (preferably $C_4$-$C_{10}$) and cycloaliphatic alcohols and mixtures thereof; glycols and glycol derivatives inclusive of $C_2$-$C_3$ (poly)alkylene glycols, glycol ethers, glycol esters and mixtures thereof; and mixtures selected from organoamine solvents, alcoholic solvents, glycols and glycol derivatives. In one preferred embodiment the organic solvent comprises organoamine (especially alkanolamine) solvent and glycol ether solvent, preferably in a weight ratio of from about 3:1 to about 1:3, and wherein the glycol ether solvent is selected from ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol monobutyl ether, and mixtures thereof. Preferably, the glycol ether is a mixture of diethylene glycol monobutyl ether and propylene glycol butyl ether, especially in a weight ratio of from about 1:2 to about 2:1.

There is also provided a method of washing dishware/tableware in an automatic dishwashing machine using the machine dishwashing product described herein. The method is suitable for simultaneous or sequential delivery of detergent actives into one or more of the pre-wash, main-wash or rinse cycles of the washing machine but is especially suitable for delivery in the main-wash or rinse cycles.

According to another aspect of the present invention, there is provided a process for making a water-soluble pouch. The pouch is suitable for use in machine washing, including laundry and dishwashing, and comprises a plurality of compartments in generally superposed or superposable relationship, each comprising a detergent active component. The process comprising the steps of: i) forming a first moving web of filled and optionally sealed pouches releasably mounted on a first moving (preferably rotating) endless surface; ii) forming a second moving web of filled and sealed pouches releasably mounted on a second moving (preferably rotating) endless surface; iii) superposing and sealing or securing said first and second moving webs to form a superposed and sealed web; and iv) separating said superposed and sealed web into a plurality of water-soluble multi-compartment pouches. In a preferred embodiment, the second moving endless surface moves in synchronism with said first moving endless surface. This facilitates to carry out the process in a continuous manner.

The first web of filled open pouches can be closed with any web closure means, such as for example a film of pouch forming material but in a preferred embodiment is preferably closed with the second web of pouches, this avoids the use of an extra layer of film. The web closure means preferably moves in synchronism with the first endless surface and the first web of open pouches mounted thereon. In preferred embodiments the second web of pouches is inverted prior to the closure of the first web of open pouches, this being preferred from the view point of facilitating the superposition on web-sealing process.

The first moving web of open pouches can be formed, for example, by feeding a water-soluble film to a die having a series of moulds. The moulds can be of any convenient size and shape, preferred for use herein being rectangular moulds having a footprint adequate to fit the majority of dishwasher dispensers. Apart from being advantageous for dispenser fit, rectangular pouches inherently have regions of different film thickness on the film and this can contribute to improve the dissolution profile of the pouch.

The open pouches can be formed using thermoforming, for example by heating the moulds or by applying heat in any other known way such as blowing hot air or using heating lamps. If desired, vacuum assistance can be employed to help drive the film into the mould. Open pouches can alternatively be formed by vacuum-forming, in which case heat assistance can be provided to facilitate the process. In general thermoforming is primarily a plastic deformation process while vacuum-forming is primarily an elastic deformation process. The two techniques can be combined to produce pouches with any desired degree of elasticity/plasticity.

The first web of open pouches is preferably formed on a first rotating endless surface, this surface being preferably horizontal or substantially horizontal during the filling of the pouches.

Thus, according to another aspect of the present invention there is provided a process for making a water-soluble pouch and which comprises a plurality of compartments in generally superposed relationship, each comprising a detergent active or auxiliary component, the process comprising the steps of forming and filling a moving horizontal or substantially horizontal web of open pouches releasably mounted on a first moving endless surface and closing the web of open pouches with a superposed moving web of pre-formed, filled and sealed pouches moving in synchronism therewith. The first endless surface is preferably moving in continuous horizontal or substantially horizontal motion and preferably in continuous horizontal rectilinear motion during the step of filling the first moving web of open pouches.

In preferred embodiments, the first open web of open pouches is filled by means of a product filling station comprising means for filling quantities of one or more product feed streams into each of the open pouches. Preferably this filling station is arranged to move in synchronism with the first web of open pouches during filling step, thereby avoiding any acceleration/deceleration of the open pouches during filling and consequent spillage of detergent and contamination of the sealing area. The horizontal rectilinear movement of the first web of open pouches allows full or more complete filling of the open pouches giving rise to a better utilisation of the film. Alternatively, the filling station can be stationary.

The detergent product can be delivered into each of the open pouches through individual dosing or dispensing devices having a single feeder or means for supplying a single product feed stream, this being preferred in cases where a single premixed composition is to be delivered into the pouch. In the case of multi component liquid compositions, each pouch can be filled by means of multiple feeders or means for supplying a plurality of product feed streams, each feeder delivering a different liquid composition (or component thereof), so as to avoid the need for a premixing step. In the case of multi component powder compositions, again each pouch can be filled by means of multiple feeders, each one delivering a powder composition (or component thereof) so as to form distinct layers of product. In the case of powder compositions it is advantageous to have a masking belt having an orifice of the same size or slightly smaller than the aperture of the open pouch, in order to avoid seal contamination.

The first web of open pouches can be optionally closed and sealed with film after filling and prior to superposing and sealing the second moving web of pouches. The second web of pouches can be made separately but in preferred embodiments the second web of pouches is horizontal or substantially horizontal during the filling of the pouches. In a preferred embodiment the step of filling the second moving horizontal web of open pouches is accomplished using a second product filling station moving in synchronism with the second endless surface. In one embodiment, the filling station comprises means for delivering a plurality of product feed streams, as in the case of the filling station for the first web of open pouches described hereinabove. Where the first web is itself sealed with film prior to superposing the two webs, the two webs may if required be secured to one another along a discontinuous seal line.

Although each of the first and second endless surfaces and the corresponding web of pouches can be adapted for movement in either a horizontal rectilinear or curvilinear manner during filling of the pouches, preferred herein is a process wherein the first endless surface is moving in horizontal rectilinear motion during the step of filling the first moving web of open pouches and wherein the second endless surface is moving in substantially horizontal rectilinear or curvilinear motion during the step of filling the second moving web of open pouches. Preferably the second endless surface rotates in a direction counter to the first endless surface.

The pouches of the second web are also preferably covered, closed and sealed with film closure means after filling and prior to superposing on the first web of pouches and sealing of the two webs. Preferred for use herein is heat sealing, that can be done by any known medium, for example direct application, infra-red, ultrasonic, radio frequency, laser. Solvent sealing can alternatively be used herein.

The web of two compartment pouches formed in this way is thereafter divided into individual pouches, for example by cutting means known per se. Preferably, the pouches are produced with a constant pitch at a constant speed, this can facilitate the automation of the packaging process. Although the process described herein above is directed to the manufacture of dual-compartment pouches, multi-compartment pouches with more than two compartments can be manufactured in a similar manner, for example by superposing and sealing three or more web of pouches. Also very useful for use herein being multi-compartment pouches in which at least one of the compartments is horizontally divided into a plurality of compartments.

According to another process aspect, there is provided a process for making a water-soluble pouch suitable for use in machine washing, including laundry and dishwashing and which comprises a plurality of compartments in generally superposed or superposable relationship, each compartment comprises a detergent active or auxiliary component, the process comprising the steps of:

a) forming and partially filling a moving web of open pouches releasably mounted on a moving endless surface, the partial filling being such as to leave sufficient space for the formation of a second compartment in the same mould;
b) closing and sealing said moving web with web closure means moving in synchronism therewith whereby the web closure means is introduced into the partially filled pouches so as to form a plurality of closed and superposed open compartments;
c) filling, closing and sealing the superposed open compartments by means of a second web closure means moving in synchronism with said moving web; and
d) separating said web into a plurality of water-soluble multi-compartment pouches.

In the above process the formation of multi-compartment pouches requires only one moving endless surface, which can be beneficial from the capital cost point of view. Each pouch is formed in a single mould. After the web of open pouches is formed, each open pouch is partially filled, closed and sealed to give rise to a second open compartment, which is itself then filled, closed and sealed. In a preferred embodiment the sealing steps are undertaken by means of solvent sealing.

The term "filling" as used herein includes both "partial" and "complete" filling of a pouch or compartment thereof. An open pouch or compartment is considered to be completely filled, when the product fills at least about 90% of the volume of the open pouch or compartment. "Partial" filling is construed accordingly.

In a slightly modified version of this process, the sealing step is undertaken at a later stage of the process. Thus, according to this aspect, there is provided a process for making a water-soluble pouch suitable for use in machine washing, including laundry and dishwashing and which comprises a plurality of compartments in generally superposed or superposable relationship, each comprising a detergent active or auxiliary component, the process comprising the steps of:

a) forming and partially filling a moving web of open pouches releasably mounted on a moving endless surface;
b) closing said moving web with web closure means moving in synchronism therewith whereby the web closure means is introduced into the partially filled pouches so as to form a plurality of closed and superposed open compartments;
c) filling and closing the superposed open compartments by means of a second web closure means moving in synchronism with said moving web;
d) sealing said web and said first and second web closure means; and
e) separating said web into a plurality of water-soluble multi-compartment pouches.

In a preferred execution of this process, the sealing step is undertaken by means of ultrasonic sealing.

In another variation on this approach, the web of open pouches in step (a) is filled, either partially or completely, with a first composition comprising a detergent active or auxiliary and thereafter either the composition is densified or the pouch enlarged to provide sufficient space for the formation of the second compartment. In the case of a powder composition, densification can be achieved by compaction, tapping, stamping, vibrating, etc, densification being preferably such as to provide a bulk density increase of at least about 5%, preferably at least about 10%, and especially at least about 20%, more preferably at least about 30%. The final bulk density is preferably at least about 0.6 g/cc, more preferably at least about 0.8 g/cc, more especially at least about 1 g/cc. Means for enlargement of the pouch includes means for altering the size or volume of the mould, for example, a moveable floor section, an insert of variable size or volume, etc.

In alternative executions, the superposed open compartments can also be formed after the step of closing and sealing the moving web of open pouches. Thus, according to a further process aspect, there is provided a process for making a water-soluble pouch which comprises a plurality of compartments in generally superposed or superposable relationship, each comprising a detergent active or auxiliary component, the process comprising the steps of:

a) forming and filling a moving web of open pouches releasably mounted on a moving endless surface;
b) closing and sealing said moving web with web closure means moving in synchronism therewith so as to form a plurality of closed compartments;
c) forming a recess within some or all of the closed compartments formed in step (b) so as to generate a plurality of open compartments superposed above the closed compartments;
d) filling, closing and sealing the superposed open compartments by means of a second web closure means moving in synchronism with said moving web; and
e) separating said web into a plurality of water-soluble multi-compartment pouches.

Again in a slightly modified version of this process, the sealing step is undertaken at a later stage of the process. Thus, according to yet another process aspect, there is provided a process for making a water-soluble pouch and which comprises a plurality of compartments in generally superposed or superposable relationship, each comprising a detergent active or auxiliary component, the process comprising the steps of:

a) forming and filling a moving web of open pouches releasably mounted on a moving endless surface;
b) closing said moving web with web closure means moving in synchronism therewith so as to form a plurality of closed compartments;
c) forming a recess within some or all of the closed compartments formed in step (b) so as to generate a plurality of open compartments superposed above the closed compartments;
d) filling and closing the superposed open compartments by means of a second web closure means moving in synchronism with said moving web;
e) sealing said web and said first and second web closure means; and
f) separating said web into a plurality of water-soluble multi-compartment pouches.

For purposes of forming the recesses, the closed compartments can be subjected to a powder compression or compaction stage as described above with, if necessary, means such as vent holes being provided in the web to enable venting of air from the compressed compartments.

In all these process aspects, the endless surface is preferably moving in continuous horizontal or substantially horizontal, preferably rectilinear, motion during the steps of filling the open pouches and superposed open compartments of the moving web. Alternatively, the motion can be intermittent, although is less preferred. It is also preferred that the steps of filling are accomplished using product filling station moving in synchronism with the endless surface. Suitably, the product filling station can comprise means for filling quantities of a plurality of product feed streams into each of said compartments.

Preferably, the multi-compartment pouches formed according to any of the processes described herein comprise a plurality of compartments containing a powder composition and a plurality of compartments containing a liquid, gel or paste composition. It will be understood moreover that by the use of appropriate feed stations, it is possible to manufacture multi-compartment pouches incorporating a number of different or distinctive powder compositions and/or different or distinctive liquid, gel or paste compositions. This can be especially valuable for manufacturing unit dose forms displaying novel visual and/or other sensorial effects.

Thus, in another process aspect, there is provided a process for forming a plurality of multi-compartment pouches in a multiplicity of sensorially distinctive groups, the process comprising filling each of a multiplicity of compartmental groups with a corresponding sensorially distinctive composition, whereby the resulting groups are distinctive in terms of colour, shape, size, pattern or ornament, or wherein the groups are distinctive in terms of providing a unique sensorial signal such as smell, sound, feel, etc.

The present invention also provides a display pack comprising an outer package such as a see-through container, for example a transparent or translucent carton or bottle which contains a plurality of water-soluble pouches or other unit doses of detergent product in a multiplicity of visually or otherwise sensorially distinctive groups. By visually distinctive herein is meant that the groups can be distinguished in terms of shape, colour, size, pattern, ornament, etc. Otherwise the groups are distinctive in terms of providing a unique sensorial signal such as smell, sound, feel, etc.

In a preferred embodiment there is provided a see-through, preferably transparent, dishwashing detergent pack wherein the number of distinctive groups of pouches or other unit doses is at least 2, preferably at least 3, more preferably at least 4, and especially at least 6 and wherein the number of unit doses per pack is at least about 10, preferably at least about 16 an more preferably at least about 20. Preferably the unit doses are multi-compartment pouches, each compartment itself possibly being visually or otherwise distinctive from the remainder of the compartments in an individual pouch. In a preferred embodiment, groups of pouches are distinctive in terms of colour. In the case of multi-compartment pouches at least one group of pouches has one compartment which is visually distinctive, for example in terms of colour, from the corresponding compartment in one or more other groups of pouches. Preferably in such embodiments, all pouch groups have at least one 'common' compartment, i.e. the appearance of which is the same from group to group. Preferably the visually distinctive compartment contains a liquid, gel or paste; the common compartment contains a powder or tablet. The pouches can be arranged in any form in the pack, either randomly or following an order, for example suitable arrangements including layers wherein each pouch comprises at least one compartment of a different colour to any of the compartments of the remainder of the pouches on the same layer. The pack can be made of plastic or any other suitable material, provided the material is strong enough to protect the pouches during transport. This kind of pack is also very useful because the user does not need to open the pack to see how many pouches there are left, the different colour pouches are very easy to identify from the exterior. Alternatively, the pack can have non-see-through outer packaging, perhaps with indicia or artwork representing the visually-distinctive contents of the pack.

In another embodiment distinctive groups of pouches contain different perfumes. The perfumes can be colour associated perfumes, for example, yellow with lemon smell, pink with strawberry smell, blue with sea smell, etc.

The processes described herein for making multi-compartment pouches can be adapted to form a plurality of pouches in a multiplicity of sensorially distinctive groups as described above, whereby each of a multiplicity of compartmental groups is filled with a corresponding sensorially-distinctive composition. This simplifies the manufacture of the display pack of the invention.

DETAILED DESCRIPTION OF THE INVENTION

The present invention envisages multi-compartment water-soluble pouches of optimum shape and dimensions to be placed in the majority of dishwasher dispensers. The pouches of the invention allow optimal use of the dishwashing machine dispenser, as well as optimal delivery and storage of dishwashing compositions, without loosing the convenience of unit dose form. The multi-compartment unit dose executions include unit dose forms comprising in separated compartments either powder, liquid or paste. Especially useful compositions are those containing an organic solvent capable of remove baked-, cook- or burnt-on soils. The invention also envisages multi-compartment executions which allow differential delivery of compositions contained in different compartments.

The invention also envisages a process for the manufacture of multi-compartment water-soluble pouches. The process is fast and very versatile, furthermore, it allows for an efficient use of the water-soluble film.

Finally, the invention envisages a detergent pack having improved display attributes and which makes it very easy for the consumer to evaluate the amount of pouches in the pack.

The dishwashing composition, or components for use herein, are contained in the internal volume space of the pouch, and are typically separated from the outside environment by a barrier of water-soluble material. Typically, different components of the composition contained in different compartments of the pouch are separated from one another by a barrier of water-soluble material.

The compartments of the water-soluble pouch may be of a different colour from each other, for example a first compartment may be green or blue, and a second compartment may be white or yellow. One compartment of the pouch may be opaque or semi-opaque, and a second compartment of the pouch may be translucent, transparent, or semi-transparent. The compartments of the pouch may be the same size, having the same internal volume, or may be different sizes having different internal volumes.

Suitable water-soluble pouches include for example dual-compartment pouches comprising loose powder, densified powder or a tablet in a first compartment and a liquid, paste, or waxy or translucent gel detergent in a second compartment. The second liquid, paste or gel compartment could also contain a separate packed powder, for example in the form of micro-beads, noodles or one or more pearlized balls allowing a delayed or sequential release effects. If the first compartment comprises a tablet, this tablet can have a recess of a size and geometrical shape, (e.g. square, round or oval) so as to partially or totally house the second compartment. In pouches comprising powder in the first compartment, the powder can be arranged in layers that can be of different colours.

Alternatively, dual compartment pouches can comprise powder of the same or different colours in the two compartments, the powder comprising flecks of one or more colours or having a uniform colour. One of the two compartments could also comprise a separate densified powder phase (allowing delayed or controlled release), for example in the form of micro-beads, noodles or one or more pearlized balls. Other dual compartment pouches comprise a single or multi-phase liquid, paste or waxy or translucent gel detergent in the two compartments, each compartment either comprising multi-phase liquid or gels being of the same or different colour and/or density. Either or both of these compartments can also comprise a separate densified powder phase (allowing delayed or controlled release), for example in the form of micro-beads, noodles or one or more pearlized balls. The compartments of all the above described dual compartment pouches can be superposed or be in superposable (e.g. side by side) relationship.

Multi-compartment pouches, having three compartments, can have superposed compartments of any geometrical shape in a sandwich like disposition, for example having either loose or compacted powder in the two outer compartments and having a liquid, paste or waxy or translucent gel in the middle compartment. Contrary, the liquid, paste or waxy or translucent gel can be in the two outer compartments, perhaps containing suspended solids and speckles, and the powder can be in the middle compartment. A multi-compartment pouch can also have a tablet with more than one recess in the first compartment and with multiple other compartments totally or partially housed in the recesses of the tablet.

The pouches can be packed in a string, each pouch being individually separable by a perforation line. Therefore, each pouch can be individually torn-off from the remainder of the string by the end-user.

Especially suitable for use herein are multi-compartment pouches having a first compartment comprising a liquid composition and a second compartment comprising a powder composition wherein the weight ratio of the liquid to the solid composition is from about 1:30 to about 30:1, preferably form about 1:1 to about 1:25 and more preferably from about 1:15 to about 1:20.

For reasons of deformability and dispenser fit under compression forces, pouches or pouch compartments containing a component which is liquid will usually contain an air bubble having a volume of up to about 50%, preferably up to about 40%, more preferably up to about 30%, more preferably up to about 20%, more preferably up to about 10% of the volume space of said compartment.

The pouch is preferably made of a pouch material which is soluble or dispersible in water, and has a water-solubility of at least 50%, preferably at least 75% or even at least 95%, as measured by the method set out here after using a glass-filter with a maximum pore size of 20 microns.

50 grams±0.1 gram of pouch material is added in a pre-weighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the % solubility or dispersability can be calculated.

Preferred pouch materials are polymeric materials, preferably polymers which are formed into a film or sheet. The pouch material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%.

The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000.

Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol.

Preferred for use herein are polymers which are from about 60% to about 98% hydrolysed, preferably about 80% to about 90% hydrolysed, to improve the dissolution characteristics of the material.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

The detergent and cleaning compositions herein can comprise traditional detergency components and can also comprise organic solvents having a cleaning function and organic solvents having a carrier or diluent function or some other specialized function. The compositions will generally be built and comprise one or more detergent active components which may be selected from bleaching agents, surfactants, alkalinity sources, enzymes, thickeners (in the case of liquid, paste, cream or gel compositions), anti-corrosion agents (e.g. sodium silicate) and disrupting and binding agents (in the case of powder, granules or tablets). Highly preferred detergent components include a builder compound, an alkalinity source, a surfactant, an enzyme and a bleaching agent.

Unless otherwise specified, the components described hereinbelow can be incorporated either in the organic solvent compositions and/or the detergent or cleaning compositions.

The organic solvents should be selected so as to be compatible with the tableware/cookware as well as with the different parts of an automatic dishwashing machine. Furthermore, the solvent system should be effective and safe to use having a volatile organic content above 1 mm Hg (and preferably above 0.1 mm Hg) of less than about 50%, preferably less than about 30%, more preferably less than about 10% by weight of the solvent system. Also they should have very mild pleasant odors. The individual organic solvents used herein generally have a boiling point above about 150° C., flash point above about 100° C. and vapor pressure below about 1 mm Hg, preferably below 0.1 mm Hg at 25° C. and atmospheric pressure.

Solvents that can be used herein include: i) alcohols, such as benzyl alcohol, 1,4-cyclohexanedimethanol, 2-ethyl-1-hexanol, furfuryl alcohol, 1,2-hexanediol and other similar materials; ii) amines, such as alkanolamines (e.g. primary alkanolamines: monoethanolamine, monoisopropanolamine, diethylethanolamine, ethyl diethanolamine; secondary alkanolamines: diethanolamine, diisopropanolamine, 2-(methylamino)ethanol; ternary alkanolamines: triethanolamine, triisopropanolamine); alkylamines (e.g. primary alkylamines: monomethylamine, monoethylamine, monopropylamine, monobutylamine, monopentylamine, cyclohexylamine), secondary alkylamines: (dimethylamine), alkylene amines (primary alkylene amines: ethylenediamine, propylenediamine) and other similar materials; iii) esters, such as ethyl lactate, methyl ester, ethyl acetoacetate, ethylene glycol monobutyl ether acetate, diethylene glycol monoethyl ether acetate, diethylene glycol monobutyl ether acetate and other similar materials; iv) glycol ethers, such as ethylene glycol monobutyl ether, diethylene glycol monobutyl ether, ethylene glycol monomethyl ether, ethylene glycol monoethyl ether, diethylene glycol monomethyl ether, diethylene glycol monoethyl ether, propylene glycol butyl ether and other similar materials; v) glycols, such as propylene glycol, diethylene glycol, hexylene glycol (2-methyl-2,4 pentanediol), triethylene glycol, composition and dipropylene glycol and other similar materials; and mixtures thereof.

Surfactant

In the methods of the present invention for use in automatic dishwashing the detergent surfactant is preferably low foaming by itself or in combination with other components (i.e. suds suppressers). Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, preferably $C_{10}$-$C_{18}$ linear or branched; cationic surfactants such as chlorine esters (U.S. Pat. No. 4,228,042, U.S. Pat. No. 4,239,660 and U.S. Pat. No. 4,260,529) and mono $C_6$-$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., BASF Poly-Tergent® SLF18), epoxy-capped poly (oxyalkylated) alcohols (e.g., BASF Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as the $C_{12}$-$C_{20}$ alkyl amine oxides (preferred amine oxides for use herein include $C_{12}$ lauryldimethyl amine oxide, $C_{14}$ and $C_{16}$ hexadecyl dimethyl amine oxide), and alkyl amphocarboxylic surfactants such as Miranol™ C2M; and zwitterionic surfactants such as the betaines and sultaines; and mixtures thereof. Surfactants suitable herein are disclosed, for example, in U.S. Pat. No. 3,929,678, U.S. Pat. No. 4,259,217, EP-A-0414 549, WO-A-93/08876 and WO-A-93/08874. Surfactants are typically present at a level of from about 0.2% to about 30% by weight, more preferably from about 0.5% to about 10% by weight, most preferably from about 1% to about 5% by weight of composition. Preferred surfactant for use herein are low foaming and include low cloud point nonionic surfactants and mixtures of higher foaming surfactants with low cloud point nonionic surfactants which act as suds suppresser therefor.

Builder

Builders suitable for use in detergent and cleaning compositions herein include water-soluble builders such as citrates, carbonates and polyphosphates e.g. sodium tripolyphosphate and sodium tripolyphosphate hexahydrate, potassium tripolyphosphate and mixed sodium and potassium tripolyphosphate salts; and partially water-soluble or insoluble builders such as crystalline layered silicates (EP-A-0164514 and EP-A-0293640) and aluminosilicates inclusive of Zeolites A, B, P, X, HS and MAP. The builder is typically present at a level of from about 1% to about 80% by weight, preferably from about 10% to about 70% by weight, most preferably from about 20% to about 60% by weight of composition.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Enzymes suitable herein include bacterial and fungal cellulases such as Carezyme and Celluzyme (Novo Nordisk A/S); peroxidases; lipases such as Amano-P (Amano Pharmaceutical Co.), M1 Lipase$^R$ and Lipomax$^R$ (Gist-Brocades) and Lipolase$^R$ and Lipolase Ultra$^R$ (Novo); cutinases; proteases such as Esperase$^R$, Alcalase$^R$, Durazym$^R$ and Savinase$^R$ (Novo) and Maxatase$^R$, Maxacal$^R$, Properase$^R$ and Maxapem$^R$ (Gist-Brocades); α and β amylases such as Purafect Ox Am$^R$ (Genencor) and Termamyl$^R$, Ban$^R$, Fungamyl$^R$, Duramyl$^R$, and Natalase$^R$ (Novo); pectinases; and mixtures thereof. Enzymes are preferably added herein as prills, granulates, or cogranulates at levels typically in the range from about 0.0001% to about 2% pure enzyme by weight of composition.

Bleaching Agent

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt (III) and related complexes (U.S. Pat. No. 4,810,410).

Low Cloud Point Non-Ionic Surfactants and Suds Suppressers

The suds suppressers suitable for use herein include nonionic surfactants having a low cloud point. "Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360-362). As used herein, a "low cloud point" nonionic surfactant is defined as a nonionic surfactant system ingredient having a cloud point of less than 30° C., preferably less than about 20° C., and even more preferably less than about 10° C., and most preferably less than about 7.5° C. Typical low cloud point nonionic surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic surfactants include, for example, ethoxylated-propoxylated alcohol (e.g., BASF Poly-Tergent® SLF18) and epoxy-capped poly(oxyalkylated) alcohols (e.g., BASF Poly-Tergent® SLF18B series of nonionics, as described, for example, in U.S. Pat. No. 5,576,281).

Preferred low cloud point surfactants are the ether-capped poly(oxyalkylated) suds suppresser having the formula:

$$R^1O-(CH_2-\underset{\underset{R^2}{|}}{CH}-O)_x-(CH_2-CH_2-O)_y-(CH_2-\underset{\underset{R^3}{|}}{CH}-O)_z-H$$

wherein $R^1$ is a linear, alkyl hydrocarbon having an average of from about 7 to about 12 carbon atoms, $R^2$ is a linear, alkyl hydrocarbon of about 1 to about 4 carbon atoms, $R^3$ is a linear, alkyl hydrocarbon of about 1 to about 4 carbon atoms, x is an integer of about 1 to about 6, y is an integer of about 4 to about 15, and z is an integer of about 4 to about 25.

Other low cloud point nonionic surfactants are the ether-capped poly(oxyalkylated) having the formula:

$$R_I O(R_{II}O)_n CH(CH_3)OR_{III}$$

wherein, $R_I$ is selected from the group consisting of linear or branched, saturated or unsaturated, substituted or unsubstituted, aliphatic or aromatic hydrocarbon radicals having from about 7 to about 12 carbon atoms; $R_{II}$ may be the same or different, and is independently selected from the group consisting of branched or linear $C_2$ to $C_7$ alkylene in any given molecule; n is a number from 1 to about 30; and $R_{III}$ is selected from the group consisting of:

(i) a 4 to 8 membered substituted, or unsubstituted heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

(b) provided that when $R^2$ is (ii) then either: (A) at least one of $R^1$ is other than $C_2$ to $C_3$ alkylene; or (B) $R^2$ has from 6 to 30 carbon atoms, and with the further proviso that when $R^2$ has from 8 to 18 carbon atoms, R is other than $C_1$ to $C_5$ alkyl.

Other suitable components herein include organic polymers having dispersant, anti-redeposition, soil release or other detergency properties invention in levels of from about 0.1% to about 30%, preferably from about 0.5% to about 15%, most preferably from about 1% to about 10% by weight of composition. Preferred anti-redeposition polymers herein include acrylic acid containing polymers such as Sokalan PA30, PA20, PAIS, PA10 and Sokalan CP10 (BASF GmbH), Acusol 45N, 480N, 460N (Rohm and Haas), acrylic acid/maleic acid copolymers such as Sokalan CP5 and acrylic/methacrylic copolymers. Preferred soil release polymers herein include alkyl and hydroxyalkyl celluloses (U.S. Pat. No. 4,000,093), polyoxyethylenes, polyoxypropylenes and copolymers thereof, and nonionic and anionic polymers based on terephthalate esters of ethylene glycol, propylene glycol and mixtures thereof.

Heavy metal sequestrants and crystal growth inhibitors are suitable for use herein in levels generally from about 0.005% to about 20%, preferably from about 0.1% to about 10%, more preferably from about 0.25% to about 7.5% and most preferably from about 0.5% to about 5% by weight of composition, for example diethylenetriamine penta (methylene phosphonate), ethylenediamine tetra(methylene phosphonate) hexamethylenediamine tetra(methylene phosphonate), ethylene diphosphonate, hydroxy-ethylene-1,1-diphosphonate, nitrilotriacetate, ethylenediaminotetracetate, ethylenediamine-N,N'-disuccinate in their salt and free acid forms.

The compositions herein can contain a corrosion inhibitor such as organic silver coating agents in levels of from about 0.05% to about 10%, preferably from about 0.1% to about 5% by weight of composition (especially paraffins such as Winog 70 sold by Wintershall, Salzbergen, Germany), nitrogen-containing corrosion inhibitor compounds (for example benzotriazole and benzimadazole—see GB-A-1137741) and Mn(II) compounds, particularly Mn(II) salts of organic ligands in levels of from about 0.005% to about 5%, preferably from about 0.01% to about 1%, more preferably from about 0.02% to about 0.4% by weight of the composition.

Other suitable components herein include colorants, water-soluble bismuth compounds such as bismuth acetate and bismuth citrate at levels of from about 0.01% to about 5%, enzyme stabilizers such as calcium ion, boric acid, propylene glycol and chlorine bleach scavengers at levels of from about 0.01% to about 6%, lime soap dispersants (see WO-A-93/

08877), suds suppressors (see WO-93/08876 and EP-A-0705324), polymeric dye transfer inhibiting agents, optical brighteners, perfumes, fillers and clay.

Liquid detergent compositions can contain low quantities of low molecular weight primary or secondary alcohols such as methanol, ethanol, propanol and isopropanol can be used in the liquid detergent of the present invention. Other suitable carrier solvents used in low quantities includes glycerol, propylene glycol, ethylene glycol, 1,2-propanediol, sorbitol and mixtures thereof.

The process used herein for forming the first and/or second moving webs involves continuously feeding a water-soluble film onto an endless surface, preferably onto a horizontal or substantially horizontal portion of an endless surface, or otherwise, onto a non-horizontal portion of this surface, such that it moves continuously towards and eventually onto the horizontal or substantially horizontal portion of the surface. Naturally, different film material and/or films of different thickness may be employed in making the first and second moving webs, where for instance compartments having different solubility or release characteristics are required.

In a preferred embodiment for making both the first and second moving webs a portion of the endless surface will move continuously in horizontal rectilinear motion, until it rotates around an axis perpendicular to the direction of motion, typically about 180 degrees, and then move in the opposite direction, usually again in horizontal rectilinear motion. Eventually, the surface will rotate again to reach its initial position. In other embodiments, the surface moves in curvilinear, for example circular motion, whereby at least a portion of the surface is substantially horizontal for a simple but finite period of time. Where employed, such embodiments are mainly valuable for making the second moving web.

The term 'endless surface' as used herein, means that the surface is endless in one dimension at least, preferably only in one dimension. For example, the surface is preferably part of a rotating platen conveyer belt comprising moulds, as described below in more detail.

The horizontal or substantially horizontal portion of the surface can have any width, typically depending on the number of rows of moulds across the width, the size of the moulds and the size of the spacing between moulds. Where designed to operate in horizontal rectilinear manner the horizontal portion of the endless surface can have any length, typically depending on the number of process steps required to take place on this portion of the surface (during the continuous horizontal motion of the surface), on the time required per step and on the optimum speed of the surface needed for these steps. Of course, by using a lower or higher continuous speed throughout the process, the length of the surface may need to be shorter or longer. For example, if several steps are performed on the horizontal portion, the portion needs to be longer or the speed slower than if for example only two steps are done on the horizontal portion.

Preferred may be that the width of the surface is up to 1.5 meters, or even up to 1.0 meters or preferably between 30 and 60 cm. Preferred may be that the horizontal portion of the endless surface is from 2 to 20 meters, or even 4 to 12 meters or even from 6 to 10 or even 9 meters.

The surface is typically moved with a constant speed throughout the process, which can be any constant speed. Preferred may be speeds of between 1 and 80 m/min, or even 10 to 60 m/min or even from 2- to 50 m/min or even 30 to 40 m/min.

The process is preferably done on an endless surface which has a horizontal motion for such a time to allow formation of the web of pouches, filling of the pouches, superposition of the second moving web of pouches, sealing of the two moving webs and cutting to separate the superposed webs into a plurality of multi-compartmental pouches. Then, pouches are removed from the surface and the surface will rotate around an axis perpendicular to the direction of motion, typically about 180 degrees, to then move in opposite direction, typically also horizontally, to then rotate again, where after step a) starts again.

Preferably, the surface is part of and/or preferably removably connected to a moving, rotating belt, for example a conveyer belt or platen conveyer belt. Then preferably, the surface can be removed and replaced with another surface having other dimensions or comprising moulds of a different shape or dimension. This allows the equipment to be cleaned easily and moreover to be used for the production of different types of pouches. This may for example be a belt having a series of platens, whereof the number and size will depend on the length of the horizontal portion and diameter of turning cycles of the surface, for example having 50 to 150 or even 60 to 120 or even 70 to 100 platens, for example each having a length (direction of motion of platen and surface) of 5 to 150 cm, preferably 10 to 100 cm or even 20 to 45 cm.

The platens then form together the endless surface or part thereof and typically the moulds are comprised on the surface of the platens, for example each platen may have a number of moulds, for example up to 20 moulds in the direction of the width, or even from 2 to 10 or even 3 to 8, and for example up to 15 or even 1 to 10 or even 2 to 6 or even 2 to 5 moulds lengthwise, i.e. in the direction of motion of the patens.

The surface, or typically the belt connected to the surface, can be continuously moved by use of any known method. Preferred is the use of a zero-elongation chain system, which drives the surface or the belt connected to the surface.

If a platen conveyer belt is used, this preferably contains a) a main belt (preferably of steel) and b) series of platens, which comprise 1) a surface with moulds, such that the platens form the endless surface with moulds described above, and 2) a vacuum chute connection and 3) preferably a base plate between the platens and the vacuum chute connection. Then, the platens are preferably mounted onto the main belt such that there is no air leakage from junctions between platens. The platen conveyer belt as a whole moves then preferably along (over; under) a static vacuum system (vacuum chamber).

Preferred may be that the surface is connected to 2 or more different vacuum systems, which each provide a different under pressure and/or provide such an under pressure in shorter or longer time-span or for a shorter or longer duration. For example, it may be preferred that a first vacuum system provides a under-pressure continuously on the area between or along the moulds/edges and another system only provides a vacuum for a certain amount of time, to draw the film into the moulds. For example, the vacuum drawing the film into the mould can be applied only for 0.2 to 5 seconds, or even 0.3 to 3 or even 2 seconds, or even 0.5 to 1.5 seconds, once the film is on the horizontal portion of the surface. This vacuum may preferably be such that it provides an under-pressure of between −100 mbar to −1000 mbar, or even from −200 mbar to −600 mbar.

Preferred may be for example that the two or more vacuum systems, or preferably pumps are connected to the chutes described above, such that each vacuum system is connected to each chute, preferably such that the systems are not interconnected with in the chute, to thus completely separate the vacuums from one another and to guarantee controlled delivery of vacuum to the moulds/surface between/along mould/edges.

It should be understood that thus all platens and the main belt move continuously, typically with the same constant speed.

The surface, or platens described above, are preferably made from corrosion resistant material, which is durable and easy to clean. Preferred may be that the surface or platens, including the mould areas are made of aluminum, preferably mixed with nickel, or optionally only the outside layers comprising nickel and/or nickel aluminum mixtures.

Preferably, at least the top layer between and/or in the moulds of the surface is of deformable resilient material, preferably at least the top layer between the moulds. The material is typically such that it has a friction coefficient of 0.1 or more, preferably 0.3 or more. For example, the top layer between the moulds, but even in the moulds, can be of rubber, silicon material or cork, preferably rubber or silicon rubber. Preferred is also that the material is not too hard, for example similar to silicon rubber having a shore value of 10 to 90.

The moulds can have any shape, length, width and depth, depending on the required dimensions of the pouches. Per surface, the moulds can also vary of size and shape from one to another, if desirable. For example, it may be preferred that the volume of the final pouches is between 5 and 300 ml, or even 10 and 150 ml or even 20 and 100 ml or even up to 80 ml and that the mould sizes are adjusted accordingly.

The feeding of the film to, and typically onto or on top of the surface and preferably onto the horizontal portion thereof, is done continuously, and thus typically with a constant speed throughout the process. This can be done by any known method, preferably by use of rollers from which the film unwinds. The film can be transported from the rollers to the surface by any means, for example guided by a belt, preferably a deformable resilient belt, for example a belt of rubber or silicone material, including silicone rubber. The material is typically such that it has a friction coefficient of 0.1 or more, preferably 0.3 or more.

Preferred may be that the rollers rewind the film with a speed of at least 100 m/min, or even 120 to 700 m/min, or even 150 to 500 m/min, or even 250 to 400 m/min.

Once on the surface, the film can be held in position, e.g. fixed or fixated on the surface, by any means. For example, the film can be held with grips or clips on the edges of the surface, where there are no moulds, or pressed down with rollers on the edges of the surface, where there are no moulds, or held down by a belt on the edges of the surface, where there are no moulds.

For ease of operating and film positioning, for improved accuracy and better alignment reliability, and as to not loose too much of the film surface (i.e. positioned in or under the grips, clips rollers or belt), and moreover as to reduce the tension on the film or ensure more homogeneous tension on the film, it is preferred that the film is held in position by application of vacuum on the film, thus drawing or pulling the film in fixed position on the surface. Typically this is done by applying a vacuum (or under-pressure) through the surface which is to hold the film, e.g under the film. Also, this method is suitable even if the film width is larger than the surface, so this system is more flexible than the use of grips of clips.

Preferably, the vacuum is applied along the edges of the film and thus typically the edges of the surface, and/or on the surface area between or around the moulds, typically along the edges of the moulds. Preferred is that the vacuum is (at least) applied along the edges of the surface.

Preferably, said surface thereto comprises holes which are connected to a device which can provide a vacuum, as known in the art, or so-called vacuum chamber(s). Thus, the surface has preferably holes along the edges of the surface and/or holes around or between the moulds.

Preferred is that the holes are small, preferably of a diameter of 0.1 mm to 20 mm, or even 0.2 to 10 mm or even 0.5 to 7 or even 1 to 5 mm.

Preferably, at least some of the holes are close to the mould edges, to reduce wrinkling in the area around the mould edges, which in a preferred embodiment herein serves as closing or sealing area; preferably the distance between the edge of the mould and the edge of the first or closest hole is 0.25 to 20 mm form the edge of the mould, or even preferably 0.5 to 5 mm or even 1 to 2 mm.

Preferred is that rows of holes are present along the edge of the surface and/or along the edges of the moulds; preferred may be that 2 or 3 or more rows of holes are present.

The use of many small holes in the manner described above ensures more homogeneous tension of the film, and it reduces the tension needed to fixate the film, and it improves the fixation and it reduces the chance of wrinkling of the film.

The use of a vacuum to fix the film in position is in particular beneficial when the film is subsequently drawn into the moulds by application of a vacuum as well, as described herein after.

The open pouches can be formed in the moulds by any method, and as described above, preferred methods include the use of (at least) a vacuum or under-pressure to draw the film into the moulds. Preferred methods (also) include heating and/or wetting the film and thereby making the film more flexible or even stretched, so that it adopts the shape of the mould; preferably, combined with applying a vacuum onto the film, which pulls the film into the moulds, or combinations of all these methods.

Preferred is that at least vacuum is used herein. In the case of pouches comprising powders it is advantageous to pin prick the film for a number of reasons: firstly, to reduce the possibility of film defects during the pouch formation, for example film defects giving rise to rupture of the film can be generated if the stretching of the film is too fast, secondly to permit the release of any gases derived from the product enclosed in the pouch, as for example oxygen formation in the case of powders containing bleach, and thirdly, to allow the continuous release of perfume. When also heat and/or wetting is used, this can be used before, during or after the use of the vacuum, preferably during or before application of the vacuum.

Preferred is thus that each mould comprises one or more holes which are connected to a system which can provide a vacuum through these holes, onto the film above the holes, as described herein in more detail. Preferred is that the vacuum system is a vacuum chamber comprises at least two different units, each separated in different compartments, as described herein.

Heat can be applied by any means, for example directly, by passing the film under a heating element or through hot air, prior to feeding it onto the surface or once on the surface, or indirectly, for example by heating the surface or applying a hot item onto the film, for example to temperatures of 50 to 120° C., or even 60 to 90° C., preferably for example with infra red light.

The film can be wetted by any mean, for example directly by spraying a wetting agent (including water, solutions of the film material or plasticisers for the film material) onto the film, prior to feeding it onto the surface or once on the surface, or indirectly by wetting the surface or by applying a wet item onto the film.

The filling of the first and second webs of open pouches can be done by any known method for filling (moving) items. The exact most preferred method depends on the product form and speed of filling required.

One method is for example flood dosing, whereby the web of open pouches passes with continuous horizontal or substantially horizontal motion under a dosing unit which is static and which has a device to accurately dose a set amount or volume of product per time unit. The problem or disadvantage of this method may be that product will be dispensed on the areas between the open pouches, which typically serves as sealing area; this not only may be a waste of product, but also makes sealing more difficult. This problem is particulate acute in the case of products in the form of mobile liquids. Paste or gel-form products are more amenable to this kind of filling process.

Generally, preferred methods include continuous motion in line filling, which uses a dispensing unit positioned above the open pouches which has a endless, rotating surface with nozzles, which typically moves rotatably with continuous motion, whereby the nozzles move with the same speed as the pouches and in the same direction, such that each open pouch is under the same nozzle or nozzles for the duration of the dispensing step. After the filling step, the nozzles rotate and return to the original position, to start another dispensing/filling step. Every nozzle or a number of nozzles together, is preferably connected to a device which can accurately control that only a set amount or volume of product is dispensed during one rotation per nozzle, e.g. thus in one pouch.

Preferred may be that the filling/dispensing system is such that from 10 to 100 cycles (filling steps) can be done per minute, or even 30 to 80 or even 40 to 70 per minute. This will of course be adjusted depending on the size of the open pouches, speed of the surface etc.

A highly preferred method for filling the open pouches suitable for surface moving in horizontal rectilinear motion is a reciprocating-motion-filling method. This process preferably uses a moving filling station which is returnable (changes direction of motion) and variable in speed. The filling station has typically a series of nozzles which each move with the same speed as the open pouches (to be filled) and in the same direction for the period that product needs to dispensed into the open pouches. Then, typically when a pouch is full, the nozzle or nozzles which filled the pouch stop their movement along with the pouch and return in opposite direction, to then stop again, such that it is positioned above another open pouch(es) which is (are) still to be filled, and to then start moving again in opposite direction, with the same speed and direction as the open pouches, until it reaches the speed of the pouches, to then continue with this speed and start dispensing and filling of the pouch(es), as in the previous filling cycle. The speed of the returning movement may be higher than the speed of the movement during filling.

Every nozzle or a number of nozzles together is preferably connected to a device which can accurately control that only a set amount or volume of product is dispensed during one rotation per nozzle, e.g. thus in one pouch.

The filling unit or station used in the process of the invention preferably uses a flow meter and/or positive displacement pump to dose the correct amounts or volumes of product per open pouch, in particular a positive displacement pump has been found to very accurate. Hereby, the required amount or volume of product is introduced in the pump and this is then fed to the nozzles. For example, if the system is such that 60 pouches are to be filled per filling cycle, typically 60 nozzles are provided, connected to 60 positive displacement pumps (one pump per nozzle, per pouch), which are all connected to a general tank with product.

The pumps can be adjusted depending on the product to be dispensed. For example, if the product is a viscous liquid, the pumps need to be stronger, if a fast filling, and thus movement of the surface is required.

Other methods which can be used include flow measurement, by use of a magnetic flow meter or mass flow meter, and pressure flow filling/measurement (which keeps the pressure constant and controlling filling time and thereby volume).

It can also be preferred to use a filling system whereby, prior to filling, a second surface with openings, which each has a surface area equal or less than the surface area of an open pouch, is placed above the continuously moving web of open pouches and is moved continuously in the direction of the web of pouches and with the speed of the web of open pouches, such that each opening remains positioned above one open pouch during the filling step and that the space between at least part of the moulds is covered by said surface, preferably said second surface being an endless, rotatably moving belt.

The filling will then take place through the openings on this surface or belt, such that the product can only enter in the open pouches and not on the area between the pouches, which is covered. This is advantageous because the area between the open pouches (between the moulds), which typically serves as sealing area when closing the pouches, remains free of product, which ensures a better or easier seal.

The filled, open pouches are then closed, which can be done by any method. Preferably, this is also done while in horizontal position and in continuous, constant motion, and preferably on the horizontal portion of the endless surface described above.

Preferred in the case of the second moving web is that the closing is done by continuously feeding a second material or film, preferably water-soluble film, over and onto the web of open pouches and then preferably sealing the first film and second film together, typically in the area between the moulds and thus between the pouches. Preferred is that the closing material is fed onto the open pouches with the same speed and moving in the same direction as the open pouches Preferred in the case of the first moving web is that the closing material is the second web of closed, filled pouches, closing being accomplished as described above, i.e. by placing the web of closed filled pouches on the open pouches in a continuous manner, preferably with constant speed and moving in the same direction of the open pouches, and which is subsequently sealed to the first film. Alternatively, the first moving web can also be closed using a film of material as described above for the second web prior to superposing and sealing the first and second moving webs of pouches. Such embodiments may be preferred in the case of multi-liquid composition containing products or where it is required to manufacture pouches in side-by-side but superposable relationship.

The sealing can be done by any method. The sealing may be done in a dis-continuous manner, for example by transporting the web of pouches to another sealing area and sealing equipment. However, the sealing is preferably done continuously and preferably with constant speed whilst the closed web of pouches moves continuously and with constant speed, and it may also preferably done in horizontal position, preferably also on said horizontal portion of the surface.

Preferred methods include heat sealing, solvent welding, and solvent or wet sealing. Hereby it may be preferred that only the area which is to form the seal, is treated with heat or solvent. The heat or solvent can be applied by any method, preferably on the closing material, preferably only on the areas which are to form the seal.

Preferred may be that when heat sealing is used, a roller with cavities of the size of the part of the pouch, which is not enclosed by the mould, and having a pattern of the pouches, is (continuously) rolled over the web pouches, passing under the roller. Hereby, the heated roller contact only the area which is to be the sealing areas, namely between the pouches, around the edges of the moulds. Typically sealing temperatures are from 50 to 300° C., or even from 80 to up to 200° C., depending on the film material of course. Also useful is a movable, returnable sealing device, operating as the returnable, movable filling/dosing device above, which contacts the area between the moulds, around the edges, for a certain time, to form the seal, and then moves away from the sealing area, to return backwards, to start another sealing cycle. In the case of heat sealing, it is important that the sealing area of the second web to the first web does not overlap the sealing area of the individual first and/or second webs of pouches.

If solvent or wet sealing or welding is used, it may be preferred that also heat is applied. Preferred wet or solvent sealing/welding methods include applying selectively solvent onto the area between the moulds, or on the closing material, by for example, spraying or printing this onto these areas, and then applying pressure onto these areas, to form the seal. Sealing rolls and belts as described above (optionally also providing heat) can be used, for example.

The superposed and sealed webs of pouches can then be cut by a cutting device, which cuts the pouches from one another, in separate superposed multi-compartment pouches which partially cuts the web so as to form multi-compartment pouches via side-by-side but superposable arrangement.

The cutting can be done by any known method. It may be preferred that the cutting is also done in continuous manner, and preferably with constant speed and preferably while in horizontal position. However, the cutting step does not need to be done in horizontal position, nor continuously. For example the web of closed (sealed) pouches can be transported to the cutting device, e.g. to another surface, where the cutting device operates. Although, for ease of processing it may be preferred to perform the cutting step on the same surface as the previous steps.

The cutting device can for example be a sharp item or a hot item, whereby in the latter case, that 'burns' through the film/sealing area. Preferred may be a roller with sharp tools, such as a knife, with cavities of the size and pattern of the pouches, which rolls over the pouches such that the sharp tools only touch the area to be cut. Preferred may also be when the web of pouches is moving in one direction (e.g. continuously and/or horizontally, for example still on the endless surface herein) a static device contacting the area between the pouches along the direction of movement can be used, to cut the pouches in the direction of movement in a continuous manner. Then, the cutting between the pouches along the direction of the width of the web of pouches can be done by an intermittent cutting step, for example by applying a cutting device for a brief period onto the area, removing the cutting device and repeating this action with the next set of pouches.

The pouch, when used herein can be of any form, shape and material which is suitable to hold the product prior to use, e.g. without allowing the release of the compositions from the pouch prior to contact of the pouched composition to water. The exact execution will depend on for example the type and amount of the compositions in the pouch, the characteristics required from the pouch to hold, protect and deliver or release the compositions, the number of compartments in the pouch.

Preferred herein are water-soluble pouches having one compartment comprising a liquid composition and another compartment comprising a powder or densified powder composition. During the manufacture of the liquid compartment an air bubble is typically formed. This air bubble can reduce the compressibility of the pouch and therefore the ease of closing the dispenser after placing the pouch therein. It has been found that ease of closing is increased when the ratio of the air bubble diameter to the maximum lateral dimension of the pouch footprint is from about 1:5 to about 1:2. Preferably, the bubble has a diameter from about 9 to about 16 mm. The bubble dimension can be controlled by process parameters.

In use, the water-soluble pouch is usually placed within the washing machine dispenser and released during the main cycle of the dishwashing process. However, the dispensers of some dishwashing machines are not completely water tight, mainly for two reasons, either the dispenser has some apertures allowing water ingress or the dispenser is sealed with a rubber band that can deform with time due to the high temperature of the dishwashing process. Water ingress into the dispenser can cause premature leaking of some of the pouch content which is thus lost at the end of the pre-wash. This problem is especially acute in the case of pouches comprising liquid compositions having a low viscosity wherein a considerable amount of the product can be lost before the main-wash cycle. The problem can be overcome by making the pouch or at least the liquid compartment thereof out of a film material which is designated to survive the pre-wash and to release the pouch contents at or after the start of the main-wash cycle. In European machines, the pre-wash is usually a cold water cycle (about 20° C. or less) without detergent and lasting for about 10 to 15 min.

Preferably the film material has a water solubility according to the hereinbelow defined test of less than about 50%, more preferably less than about 20% and especially less than about 5% under cold water conditions (20° C. or below) when exposed to the water for at least 10 minutes, preferably at least 15 minutes; and a water solubility of at least about 50%, more preferably at least about 75% and especially at least about 95% under warm water conditions (30° C. or above, preferably 40° C. or above) when exposed to the water for about 5 minutes and preferably when exposed to the water for about 3 minutes. Such film materials are herein referred to as being substantially insoluble in cold water but soluble in warm water. Sometimes this is abbreviated simply to "warm water soluble".

50 grams±0.1 gram of pouch material is added in a preweighed 400 ml beaker and 245 ml±1 ml of distilled water is added. This is kept at the desired temperature, by using a water bath, and stirred vigorously on a magnetic stirrer set at 600 rpm, for the desired time. Then, the mixture is filtered through a folded qualitative sintered-glass filter with a maximum pore size of 20 μm. The water is dried off from the collected filtrate by any conventional method, and the weight of the remaining material is determined (which is the dissolved or dispersed fraction). Then, the % solubility or dispersability can be calculated.

Commercially available films insoluble in cold water and soluble in hot water include BP26 available from Aicello, L10 and L15 available from Aquafilm, VF-M and VM-S available from Kuraray and E-2060 available from Monosol.

In a preferred embodiment a multi-compartment pouch comprises a first compartment comprising a liquid composition and a second compartment comprising a powder or densified powder composition. Preferably, the liquid compartment is made of a warm water-soluble material as described hereinabove and the powder or densified powder compartment is made of cold water-soluble material, i.e., a material which is soluble to an extent of at least 50%, preferably at least 75%, more preferably at least 95% by weight under cold water conditions (20° C. or below) when exposed to the water for about 5 minutes and preferably when exposed to the water for about 3 minutes. Due to the way in which European dishwashing machines operate (they are filled with cold water and the cold water is heated by means of a heater), the compartment made of warm water-soluble material takes longer to dissolve than the compartment made of cold water-soluble material. This kind of pouch allows for a delayed release of the liquid composition providing optimised use of the detergent composition. Preferably, the liquid composition comprises detergency enzyme, this being advantageous from the enzyme storage stability viewpoint, the enzyme being separated from the bleach and from highly alkaline materials contained in the powder or densified powder composition. Furthermore, the liquid containing compartment (substantially cold water-insoluble and warm water-soluble) will take longer to dissolve or disintegrate than the solid containing compartment (cold water-soluble), minimizing the negative interaction in the wash liquor between bleach and enzymes and between surfactant and enzymes and providing improved protein soil removal and spotting benefits in the later stages of the dishwashing process.

Pouch compartments containing solid compositions, in particular oxygen bleach comprising compositions, are usually pin-pricked in order to allow the leakage of any formed oxygen. The holes formed by pin pricking also allow the leakage of perfumes or malodors, however. For example, surfactants often have an unpleasant smell associated with them and when such pouches are packed within a secondary package, the unpleasant surfactant smell can be concentrated into the package head space and released each time that the user open the package. This problem can be avoided by including the surfactant in the liquid composition, since liquid containing compartments must be made free of pin holes. Thus, according to another embodiment, the liquid composition comprises a surfactant. Another advantage of having the surfactant in the liquid phase is to avoid problems of loading the surfactant onto the solid material. A further advantage is that the surfactant is released with a certain delay with respect to the solid composition, this allows better performance of the bleach and enzymes which can be adversely affected by interaction between the surfactant and the table/dishware surfaces.

Preferably perfume is introduced in the solid composition, pin prickling allowing for slow release of the perfume before the product is used in the dishwasher.

Films substantially insoluble in cold water and soluble in warm water have relatively low moisture and plasticiser content, therefore the film would require a significant time and temperature in order to seal by means of heat sealing. These requirements can lead to damage of the film such as for example pin-holes at the point where the film is stretched into the mould, causing leakage, especially problematic in the case of pouches containing liquid. Therefore, it is preferred that compartments made of films substantially insoluble in cold water and soluble in warm water and which house liquids are sealed using solvent which partially hydrates the film prior to sealing, lowering the time and temperature required for sealing, generating strong seals and avoiding pin-hole formation. In the preferred embodiment of differential solubility pouches having one compartment comprising a liquid composition and another compartment comprising a powder composition wherein the liquid compartment is made of material substantially insoluble in cold water and soluble in warm water and the powder compartment is made of material which is soluble in cold water, it is preferred that the liquid compartment be sealed by solvent-sealing while the liquid compartment is sealed to the powder compartment by heat sealing.

The pouch can also be placed outside the dispenser, for example in the cutlery basket, in a net or on the door of the dishwasher. In this case, it is preferred to make the entire pouch of a film material, as for example the one described herein above, which protects the pouch content until at least the start of the main-wash cycle.

Although the nature of the pouched products is such that it readily dissolves or disperses into the water, it may be preferred that disintegrating agents such as effervescence sources, water-swellable polymers or clays are present in the pouch itself, and/or in the product therein, in particular effervescence sources based on an acid and a carbonate source. Suitable acids include the organic carboxylic acids such as fumaric acid, maleic acid, malic acid, citric acid; suitable carbonate sources include sodium salts of carbonate, bicarbonate, percarbonate. Preferred levels for the disintegrating aids or effervescence sources or both are from 0.05% to 15% or even from 0.2% to 10% or even form 0.3 to 5% by weight of total pouched composition.

EXAMPLES

Abbreviations Used in Examples

In the examples, the abbreviated component identifications have the following meanings:

Carbonate: Anhydrous sodium carbonate
STPP: Sodium tripolyphosphate
Silicate: Amorphous Sodium Silicate ($SiO_2$:$Na_2O$=from 2:1 to 4:1)
HEDP: Ethane 1-hydroxy-1,1-diphosphonic acid
Perborate: Sodium perborate monohydrate
Percarbonate: Sodium percarbonate of the nominal formula $2Na_2CO_3.3H_2O_2$
Carbonate: Anhydrous sodium carbonate
Termamyl: α-amylase available from Novo Nordisk A/S
Savinase: protease available from Novo Nordisk A/S
FN3: protease available from Genencor
SLF18: Poly-Tergent® available from BASF
ACNI: alkyl capped non-ionic surfactant of formula $C_{9/11}H_{19/23}EO_8$-cyclohexyl acetal
$C_{14}$AO: tetradecyl dimethyl amine oxide
$C_{16}$AO: hexadecyl dimethyl amine oxide
Duramyl: α-amylase available from Novo Nordisk A/S
DPM: dipropylene glycol methyl ether
DPG: dipropylene glycol
Methocel: cellulosic thickener available from Dow Chemical In the following examples all levels are quoted as percent (%) by weight.

Examples 1 to 8

The compositions of examples 1 to 4 are introduced in a two compartment layered PVA rectangular base pouch. The dual compartment pouch is made from a Monosol M8630 film as supplied by Chris-Craft Industrial Products. 17.2 g of the particulate composition and 4 g of the liquid composition are placed in the two different compartments of the pouch. The pouch dimensions under 2 Kg load are: length 3.7 cm, width 3.4 cm and height 1.5 cm. The longitudinal/transverse aspect ratio is thus 1.5:3.2 or 1:2.47. The pouch is manufactured using a two-endless surface process, both surfaces moving in continuous horizontal rectilinear motion as herein described. According to this process a first web of pouches is prepared by forming and filling a first moving web of open pouches mounted on the first endless surface and closing the first web of open pouches with the second web of filled and sealed pouches moving in synchronism therewith.

The pouch is introduced in the 25 ml dispenser compartment of a Bosch Siemens 6032 dishwashing machine, the dispenser is closed and the washing machine operated in its normal 55° C. program.

| | Example | | | |
|---|---|---|---|---|
| | 1 | 2 | 3 | 4 |
| Particulate composition | | | | |
| $C_{14}$ AO | 5 | | 5 | |
| $C_{16}$ AO | | 5 | | 5 |
| ACNI | 5 | | | 5 |
| SLF18 | | 5 | 5 | |
| STPP | 55 | 55 | 56 | 56 |
| HEDP | 1 | 1 | 1 | 1 |
| Termamyl | 1.5 | 1.5 | | |
| FN3 | 2 | 2 | | |
| Percarbonate | 15 | 15 | 15.5 | 15.5 |
| Carbonate | 9 | 9 | 10 | 10 |
| Silicate | 6 | 6 | 7 | 7 |
| Perfume | 0.5 | 0.5 | 0.5 | 0.5 |
| Liquid composition | | | | |
| DPG | 99.5 | 99.5 | 95 | 95 |
| FN3 Liquid | | | 2.6 | 2.4 |
| Duramyl Liquid | | | 2.0 | 2.4 |
| Dye | 0.5 | 0.5 | 0.4 | 0.2 |

| | Example | | | |
|---|---|---|---|---|
| | 5 | 6 | 7 | 8 |
| Particulate composition | | | | |
| STPP | 60 | 60 | 61 | 61 |
| HEDP | 1 | 1 | 1 | 1 |
| Termamyl | 1.5 | 1.5 | | |
| FN3 | 2 | 2 | | |
| Percarbonate | 17 | 17 | 17.5 | 17.5 |
| Carbonate | 11 | 11 | 12 | 12 |
| Silicate | 7 | 7 | 8 | 8 |
| Perfume | 0.5 | 0.5 | 0.5 | 0.5 |
| Liquid composition | | | | |
| DPG | 59.5 | 59.5 | 55 | 55 |
| FN3 Liquid | | | 2.6 | 2.4 |
| Duramyl Liquid | | | 2.0 | 2.4 |
| $C_{14}$ AO | 20 | | 20 | |
| $C_{16}$ AO | | 20 | | 20 |
| ACNI | | 20 | | 20 |
| SLF18 | 20 | | 20 | |
| Dye | 0.5 | 0.5 | 0.4 | 0.2 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A water-soluble pouch comprising a plurality of compartments in generally superposed relationship, each compartment containing a composition that is a liquid composition comprising one more detergent active or auxiliary components, wherein the one or more detergent active or auxiliary components in a first compartment is in the form of a liquid, and wherein the one or more detergent active or auxiliary components in a second compartment is in the form of a liquid; wherein each of the one or more of said plurality of compartments further comprises an organic solvent system.

2. A pouch according to claim 1, wherein said pouch has a volume of from about 5 to about 70 ml.

3. A pouch according to claim 1, wherein said pouch comprises upper and lower generally opposing outer walls, a skirt-like side wall, and one or more internal partitioning walls.

4. A pouch according to claim 3, wherein each of said upper and lower outer walls and said skirt-like side wall are formed by a method selected from the group consisting of thermoforming, vacuum forming, and combinations thereof.

5. A pouch according to claim 3, wherein each internal partitioning wall is secured to an outer or side wall of said pouch along a single seal line or to both an outer and a side wall of said pouch along a plurality of seal lines that are at least partially non-overlapping.

6. A pouch according to claim 3, wherein each partitioning wall is secured to one or more outer or side walls by heat or solvent sealing.

7. A pouch according to claim 1 wherein one or more of said plurality of compartments comprises detergency enzyme.

8. A pouch according to claim 1 wherein said organic solvent system is selected from the group consisting of alcohols, amines, esters, glycol ethers, glycols, terpenes, and mixtures thereof.

9. A pouch according to claim 1 wherein said organic solvent system is selected from the group consisting of organoamine solvents, alcoholic solvents, glycols, glycol derivatives, and mixtures thereof; wherein said organoamine solvents are selected from the group consisting of alkanolamines, alkylamines, alkyleneamines, and mixtures thereof; wherein said alcoholic solvents are selected from the group consisting of aromatic alcohols, aliphatic alcohols, cycloaliphatic alcohols, and mixtures thereof; and wherein said glycols and glycol derivatives are selected from the group consisting of $C_2$-$C_3$ (poly)alkylene glycols, glycol ethers, glycol esters, and mixtures thereof.

10. A pouch according to claim 1, wherein said one or more liquid detergent active or auxiliary components in said first compartment comprises a surfactant.

11. A pouch according to claim 10, wherein said surfactant comprises anionic surfactant, wherein said anionic surfactant comprises alkyl sulfates, alkyl ether sulfates, alkyl benzene sulfates, or mixtures thereof.

12. A pouch according to claim 1, wherein said pouch comprises three compartments.

13. A pouch according to claim 1, wherein each compartment is visually distinctive from the remainder of the compartments.

14. A multi-compartment pouch comprising a plurality of compartments in a generally superposed relationship, wherein each compartment comprises one or more detergent active components or detergent auxiliaries, and wherein each compartment comprises a liquid composition that comprises an organic solvent system.

15. A pouch according to claim 14, wherein the pouch comprises three compartments.

16. A pouch according to claim 14, wherein the one or more detergent active components or detergent auxiliaries comprises surfactant.

17. A pouch according to claim 14, wherein at least one of the liquid compositions comprises surfactant.

18. A pouch according to claim 14, wherein each compartment is visually distinctive from the remainder of the compartments.

19. A pouch according to claim 14, wherein said pouch comprises upper and lower generally opposing outer walls, and one or more internal partitioning walls.

20. A pouch according to claim 19, wherein each internal partitioning wall is secured to an outer wall of said pouch.

* * * * *